US005368405A

United States Patent [19]

Sixiong

[11] Patent Number: 5,368,405

[45] Date of Patent: Nov. 29, 1994

[54] NON-MINGLING MULTICOLOR MARKER AND ITS PROCESS

[76] Inventor: Xie Sixiong, 258 Shi Mong Yi Road, Shanghai, China

[21] Appl. No.: 56,595

[22] Filed: May 4, 1993

Related U.S. Application Data

[63] Continuation of Ser. No. 842,940, Feb. 27, 1992, abandoned, which is a continuation-in-part of Ser. No. 596,449, Oct. 12, 1990, abandoned.

[30] Foreign Application Priority Data

Oct. 30, 1989 [CN] China ..... 89218857.X

[51] Int. Cl.[5] ..... B43K 8/08; B43K 27/08; B43K 17/00

[52] U.S. Cl. ..... 401/35; 401/17; 401/199

[58] Field of Search ..... 401/28, 17, 29, 34, 401/35, 36, 198, 199, 192, 194

[56] References Cited

U.S. PATENT DOCUMENTS

| | | | |
|---|---|---|---|
| 2,025,938 | 12/1935 | DeMario | 401/29 X |
| 2,032,983 | 3/1936 | Hackney | 401/35 X |
| 2,044,792 | 6/1936 | Hoyle | 401/35 |
| 2,100,647 | 11/1937 | Karl et al. | 401/32 |
| 2,219,769 | 10/1940 | Dorfman | 401/194 X |
| 2,554,335 | 5/1951 | Kollsman | 401/35 |
| 2,608,953 | 9/1952 | Kollsman | 401/35 |
| 2,639,506 | 5/1953 | Lory | 401/35 X |
| 3,247,828 | 4/1966 | Basham | 401/198 X |
| 3,887,287 | 6/1975 | Rosh | 401/35 |
| 4,692,046 | 9/1987 | Lan | 401/32 |
| 5,017,034 | 5/1991 | Stary | 401/35 |
| 5,067,837 | 11/1991 | Panopoulus | 401/198 X |

FOREIGN PATENT DOCUMENTS

| | | | |
|---|---|---|---|
| 126851 | 5/1901 | Germany | 401/35 |

*Primary Examiner*—Danton D. DeMille
*Attorney, Agent, or Firm*—James A. Wong

[57] ABSTRACT

A non-mingling multicoloring pen comprising a barrel, ink reserooirs, a combined tip comprising a nib guard tube, two or more elastic nibs with ink tight surfaces fixed separatedly from each other in the nib guard tube by means of a nib position fixing means with the front ends of all nibs sticking out of the front end of the said nib guard tube, and the rear ends of the nibs being inserted into the front ends of the said ink reservoirs, a movable nib holder with a conical bore being mounted axially movably on the front end of the nib guard tube, and sheathing the front ends of the nibs. When the ink pen is in use, the nib holder forces the nibs to close up with each other to give various single color or mixed color lines, when the ink pen is not in use, the nibs of the ink pen can be released loose to restore its original separated state, thereby the color mingling is prevented.

12 Claims, 7 Drawing Sheets

FIG. 8A
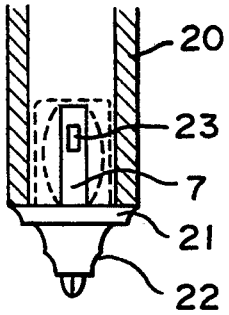
FIG. 8B
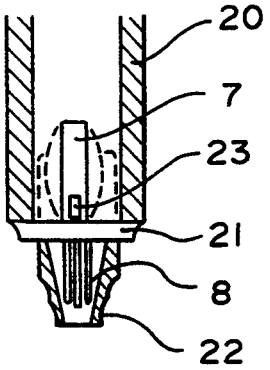
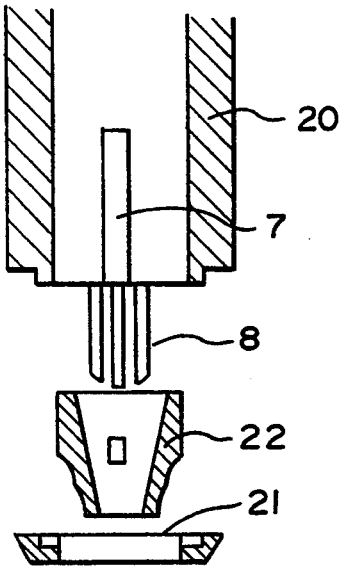
FIG. 7
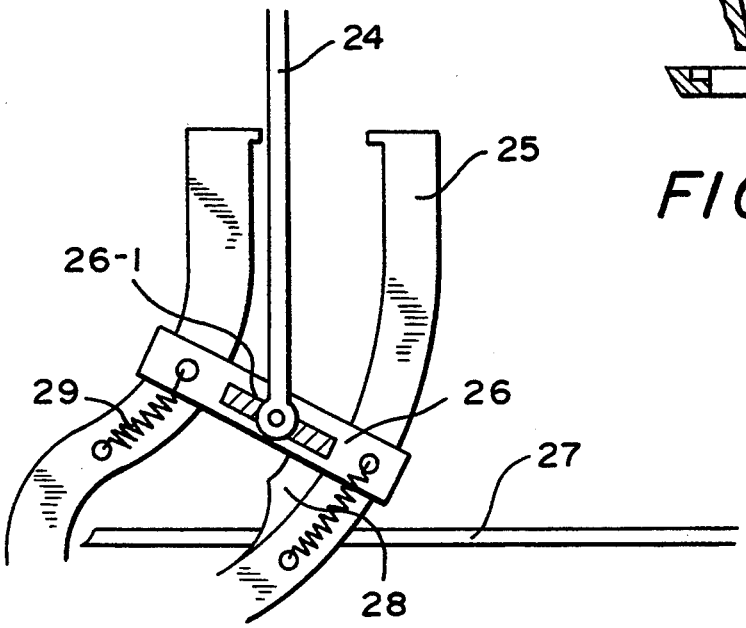
FIG. 9

NON-MINGLING MULTICOLOR MARKER AND ITS PROCESS

This is a continuation of application Ser. No. 842,940 filed Feb. 27, 1992 now abandoned, which is a continuation of application Ser. No. 596,449 filed Oct. 12, 1990 now abandoned.

The present invention relates to a multicolor ink pen-,and particularly to a non-mingling multicolor ink pen.

Chinese Patent No. 87107887 disclosed a "multicolor bunched pen in which several nibs with ink tight surface are bunched together in close contact in a nib guard tube to form a combined tip". Later on, the above-mentioned Patent was further improved by a process in which the front end of the combined tip is machined as a whole. It makes the shape of the whole end into a convex surface, thereby the clearance among the nib points is minimized to form a so-called "multicolor ink pen". Then the color of the ink pen may be continuously varied as desired in writing occurring and any twin line of different colors is eliminated as well.

However, since the combined tip structure is constituted by several nibs with ink tight surface bunched permanently together in close contact, the clearance between ink outlet of different nib points is very small. When nib points are subject to variation in temperature and atmospheric pressure, pressure difference caused by ink amounts in ink reservoirs. particularly with reservoirs full of ink after a long while, such structure will make the different color liquids in each nib move across the minute clearance of nib points and mingle with adjacent nib due to capillary action, resulting in a mingling of colors in the adjacent nib, which is not the desired color of the user. And what is worse, the color inks in the ink reservoirs will mix up with each other which makes the ink pen totally damaged. It is hard to get qualified product of the multicolor ink pen.

U.S. Pat. No. 4,692,046 to Lan has disclosed a muticolor pen; Lan's pen can not write mixed color lines or twin lines with different space, as only one of the nibs can stick out of the front end of the nib guard tube. Rosh, Jr.'s pen in U.S. Pat. No. 3,887,287 can not write mixed color lines/characters or twin lines with different space, as there are external partition members between nibs 20. Kollsman's pen (U.S. Pat. No. 2,554,335) can not write mixed color characters and twin color lines with different space for the space between the balls are fixed.

One object of the present invention is to provide a non-mingling multicolor ink pen, in which the clearance among the nib points is adjustable, and in a certain range, to write single color, or mixed color lines, or twin different color lines with different space. When writing is finished, the nibs can be released to restore their original separated state to prevent the color-mingling between the nib points so as to insure the quality of the multicolor ink pen. Another object of the present invention is to provide a non-mingling multicolor ink pen with color identification means for convenience to use and color selection in writing.

The technical conception of the present invention is:

A non-mingling multicolor ink pen comprising a barrel, ink reservoirs fitted in the barrel and a combined tip, said combined tip comprising a nib guard tube, two or more elastic nibs with ink tight surface fixed separately from each other in said nib guard tube by means of a nib position fixing means, their front ends being all sticking out of the front end of said nib guard tube and the rear end of said nib guard tube being connected to the front end of said barrel, the rear ends of nibs being inserted in the front end of the ink reservoirs, a movable nib holder with a front end opening whose bore being a conical hole being mounted axially movably to the front end of said nib guard tube and sheathing the front ends of the nibs.

The nibs of the non-mingling multicolor ink pen of the present invention are separated from each other when not in use so that there will be no mingling problem arising from the clearance between nib points being too small. And while in use, the nibs are forced to close up elastically by the conical bore of the movable nib holder through its axial movement so as to be able to write out various single color or mixed color lines, as the clearance between nib points being very small. While in writing, a turning of the barrel for a certain angular degree will make it possible to write out a single color or a mixed color line. Besides, it is possible to control the clearance among nibs by controlling the axial position of the movable nib holder so as to write out twin color lines with different space.

In preferred embodiments of the present invention, two types of nib guard tube of the combined tip are disclosed with two types of movable nib holder to match. In addition, further disclosed is a non-mingling multicolor ink pen with various color identification means so as to enable users to select color more conveniently and accurately. All these will help common technicians in this field be enlightened so as to facilitate the realization of the present invention.

The features and advantages of the present invention are further illustrated by the following accompanying drawings and preferred embodiments. In which.

FIG. 7 is a schematic sectional view of another type of non-mingling multicolor ink pen of the present invention in a similar position as FIG. 5;

FIGS. 8, 9 are schematic views of two types of segment fixing block of the multicolor ink pen shown in FIG. 7;

Figure 1A:
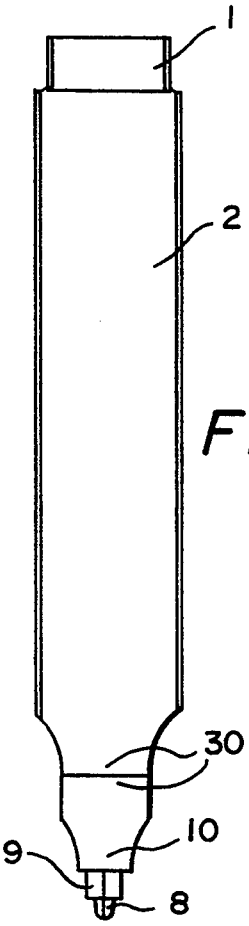
FIG. 1 is a schematic appearance view of the non-mingling multicolor ink pen of the present invention.
Figure 1B:
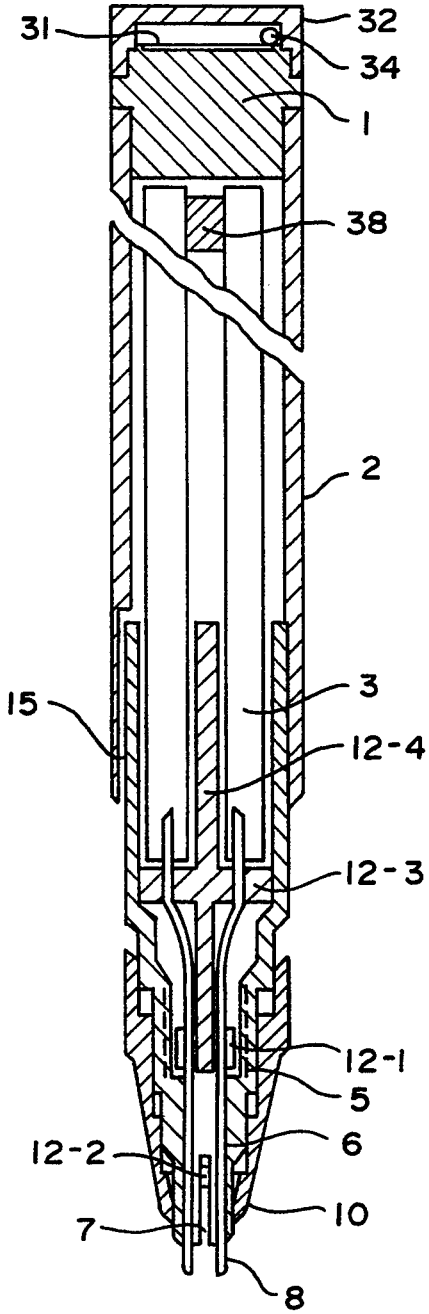
Figure 2:
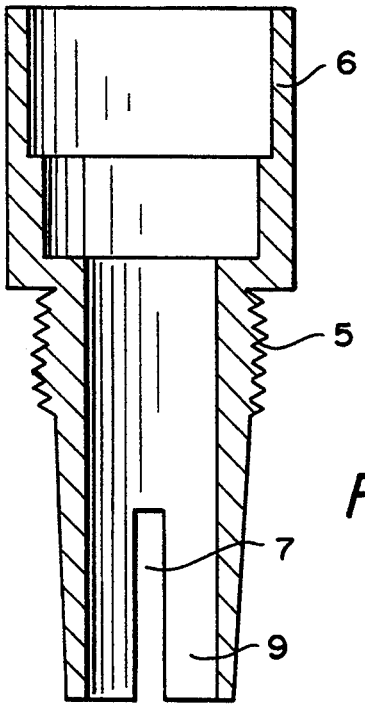
FIG. 2 is a schematic sectional view of the multicolor ink pen shown in FIG. 1.

Refer to FIGS. 1 and 2. A non-mingling multicolor ink pen of the present invention comprises a barrel 2, ink reservoirs 3 fitted in barrel 2, and a combined tip. The combined tip comprises a nib guard tube 6, two or more, for instance 3, elastic nibs 8 with ink tight surface fixed separately from each other in said nib guard tube by means of a nib position fixing means. The front ends of nibs 8 stick out of the front end of said nib guard tube, while the rear end of said nib guard tube 6 is fixedly inserted An the front end of the barrel 2 and the rear ends of nibs 8 are inserted in the front ends of ink reservoirs 3. A movable nib holder 10 with a front end opening is mounted axially movably on the front end of said nib guard tube 6 and sheaths the front end of nibs 8. The bore of the nib holder is a conical hole. The ink pen is also provided with an air hole 100 as usual on the barrel 2, for example, in the connecting portion of the barrel 2 and the nib guard tube 6 (See FIG. 2).

Figure 3A:
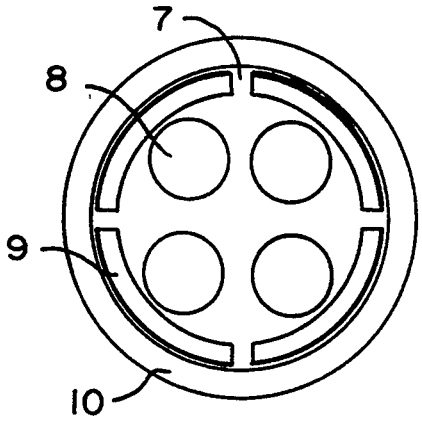
FIG. 3 is a schematic sectional view of the nib guard tube of the multicolor ink pen shown in FIG. 2.
Figure 3B:
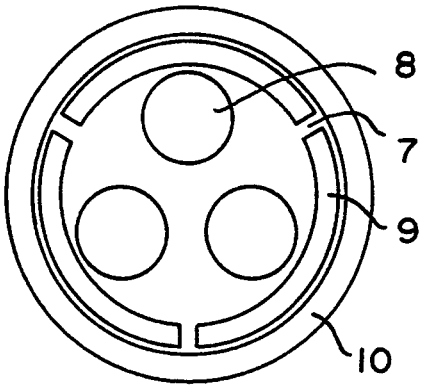

Refer to FIG. 3. On the front tube wall of the nib guard tube 6 of this embodiment are defined axial slots 7 equal in number to said nibs, so as to form several segmented pieces, thus the nibs 8 can be positioned on the inner side of the segmented pieces 9 (See FIG. 2). On the intermediate outside of the nib guard tube is machined an outer thread 5, while on the rear inside of the movable nib holder is machined an inner thread 11, and thus the movable nib holder 10 can be, by means of the connection of its inner thread 11, and the outer thread 5, axially movably mounted on the front end of said nib guard tube 6 and sheathes the front ends of nibs 8. Since the bore of the movable nib holder 10 is conical, this conical bore will force the segmented pieces on the front end of the nib guard tube 6 and the nibs 8 on its inner side to close up with each other when the movable nib holder 10 is screwed upward. Then, the end portion of the combined tip as a whole will be in a convex curved shape with very small clearance among front ends of nibs 8, as the front end of each nib 8 is in a partial convex curved shape, so as to facilitate writing of various single and mixed color lines. Besides, it is possible to control its axial position by screwing the movable nib holder 10, and to control further the degree of tightness to the segmented pieces 9 and nibs 8 so as to adjust the clearance among the front ends of nibs 8 and to write out twin color lines of different space. When writing is finished, the movable nib holder 10 is screwed loose, and the segmented pieces 9 and nibs 8 will separate from each other, so as to prevent the clearance among the front ends of nibs 8 from being too small which results in a problem of color intermingling. Such is the most outstanding advantage of the present invention.

Figure 4A:
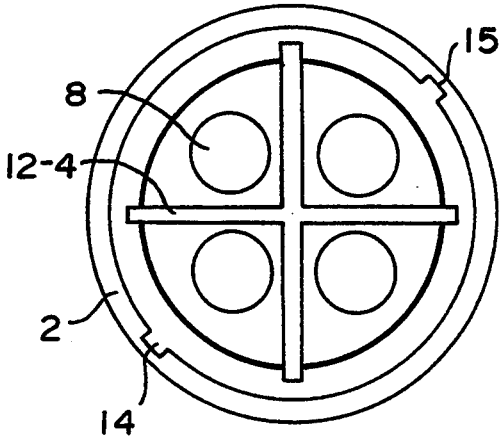
FIG. 4 is a schematic exploded perspective view of the combined tip of the multicolor ink pen shown in FIG. 2.
Figure 4B:
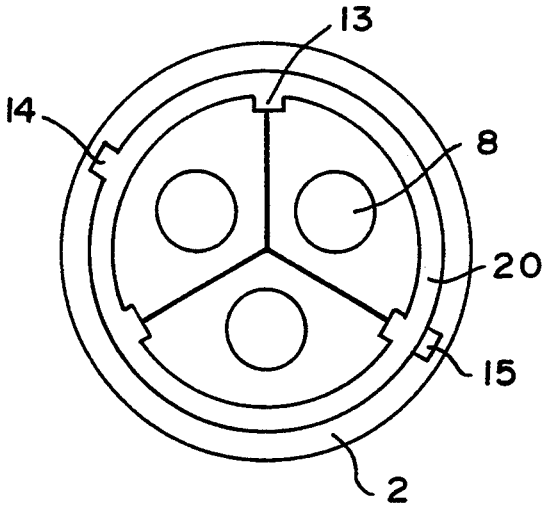

In the above-mentioned embodiment, the nib position fixing means in the combined tip comprises, referring to FIG. 2 and 4, a circular fixing block 12-3 embedded in the middle of the nib guard tube 6, on which are uniformly defined holes equal in number to nibs, nibs 8 are respectively and fixedly inserted in the holes; a positioning support 12-4 fixed to said fixing block 12-3, for instance, being inserted said fixing block 12-3, or integrated into one piece with fixing block 12-3 and carried with radial protruding pieces equal in number to nibs 8, the radial protruding pieces are embedded in match into positioning grooves 17 on the rear inside of the nib guard tube 8; front portions of the ink reservoirs 3 respectively locate between two adjacent radial protruding pieces of said positioning support 12-4; an elastic positioning frame 12-2 located in front of the circular fixing block 12-3, said positioning frame 12-2 also carries radial protruding pieces equal in number to nibs 8, the front portions of nibs 8 is located respectively between two adjacent radial protruding pieces of said positioning frame 12-2; and a positioning ring 12-1 located between the circular fixing block 12-3 and the positioning frame 12-2, said positioning ring 12-1 is fixedly put round the intermediate outside of the nibs 8.

Figure 5:
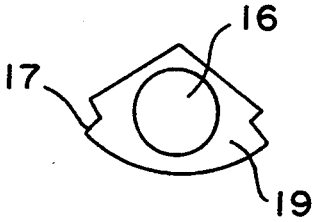
FIG. 5 is a schematic sectional view along line A—A in FIG. 2.

FIG. 5 shows a position relationship of ink reservoirs 3 with the nib position fixing means.

Figure 6:
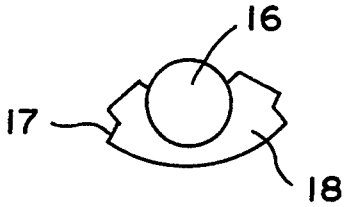
FIGS. 6A, 6B show a schematic end view of the tip point of the multicolor ink pen shown in FIG. 2.

FIG. 6A, 6B show a position relationship of the movable nib holder 10, nib guard tube 6, segmented pieces 9 and nibs 8 when not in use. It can be seen that the nibs 8 are separated with each other when not in use, and hence no problem of color intermingling will occur among nibs.

The nib position fixing means in the above-mentioned embodiment can be replaced by another type as shown in FIG. 7, it comprises segment positioning pieces 14 equal in number to nibs and embedded in the intermediate inside of the nib guard tube 6 to be combined into a circular fixing block. Refer to FIGS. 8, 9. Each positioning pieces 14 is provided with a nib hole or slot 18, and nibs 8 are respectively and fixedly inserted in the holes or slots 16 of the positioning pieces 14. Radial positioning protruding pieces 13 are uniformly defined along periphery in rear inside of the nib guard tube 6, equal in number to the positioning pieces 14. See FIG. 7. At each corner of both edges of each positioning piece 14 is defined a positioning notch 15 with a width equal to half of that of the radial protruding positioning piece 13 on the nib guard tube 6, the radial protruding positioning pieces 13 are embedded respectively in the said notches 15 so as positioning pieces 14 together with the nibs 8.

Figures 10, 11:
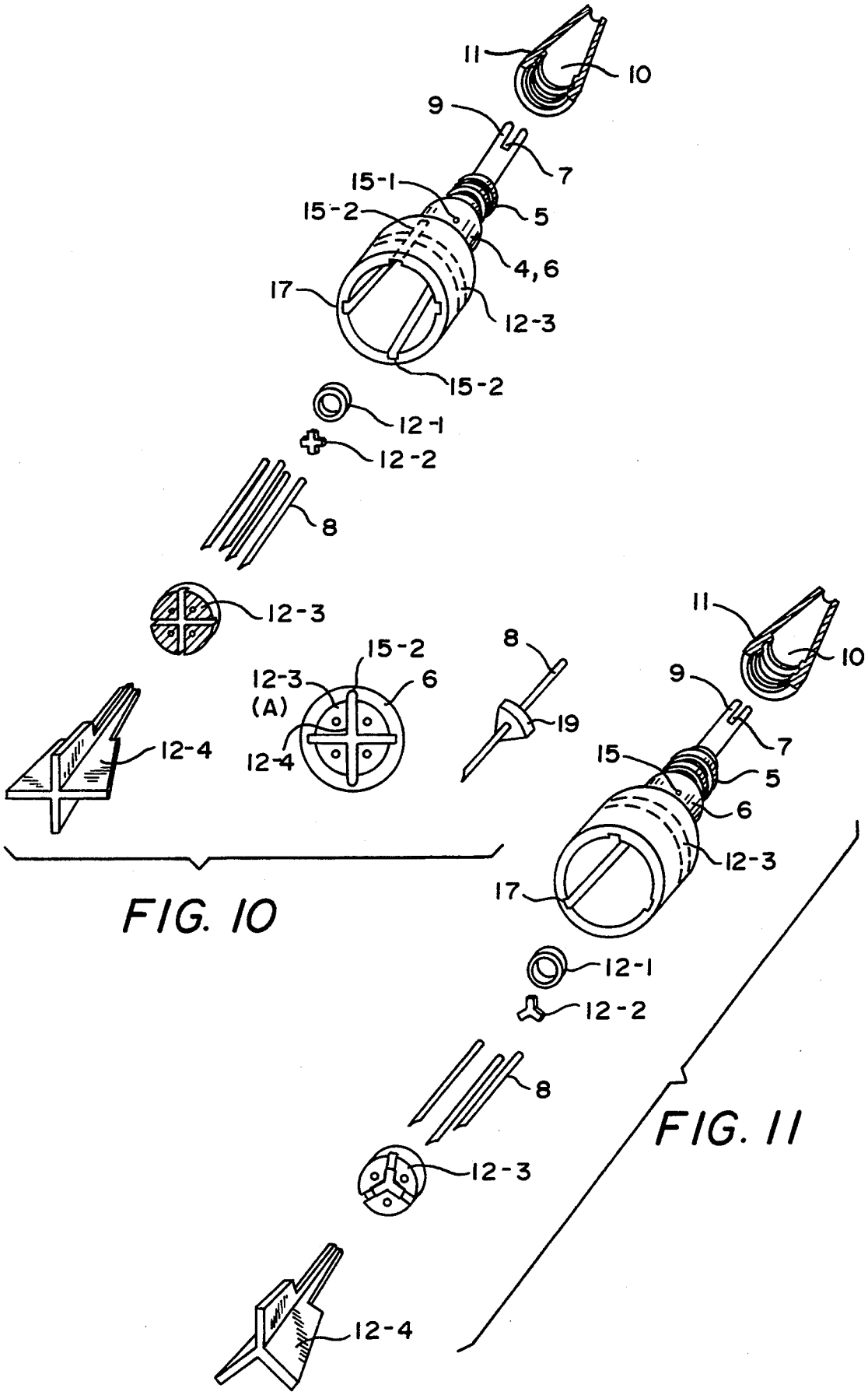
FIG. 10 is a schematic view of the exploded structure of still another type of combined tip of the non-mingling multicolor ink pen of the present invention.
FIGS. 11, 12 show respectively the combined tip of the multicolor ink pen shown in FIG. 10 when in use and not in use.
Figure 12:
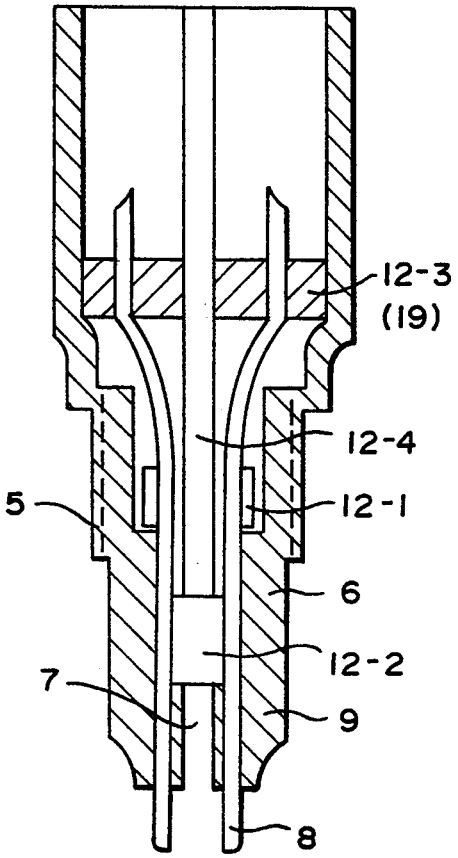

The present invention provides a non-mingling multicolor ink pen with another type of combined tip. Refer to FIG. 10, 11, and 12. Said combined tip comprises a nib guard tube 20, in which nibs 8 are separately fixed with each other by means of a nib position fixing means. The nib position fixing means can be of any type as mentioned above. One or a plurality of axial slots 18 is defined in the front portion of the nib guard tube 20. A movable nib holder 22 is fitted axially movably in the front end of the nib guard tube 20. And at its rear outside is disposed one or a plurality of radial protruding pieces 23 sticking out of the slots 18 on the nib guard tube 20. The movable nib holder meanwhile sheathes the front end of nibs 8, whose bore is a conical hole. Thus, when in use, turn the radial protruding piece 23 by fingers to push the movable nib holder 22 upward, and its conical bore will force the nibs 8 to close up with each other, shown in FIG. 11, then it will be ready to write out single or mixed color lines. By adjusting the axial position of the movable nib holder , the clearance among nibs 8 can be adjusted so as to write out twin color lines with different space. When writing is finished, the movable nib holder is pushed down to separate the nibs from each other and thus to prevent from color intermingling among them. See FIG. 12. If the axial slots 18 is extended to the front end of the nib guard tube 20, then a gland 21 is required to be fitted at its front end to prevent the movable nib holder from dropping.

Figure 13A:
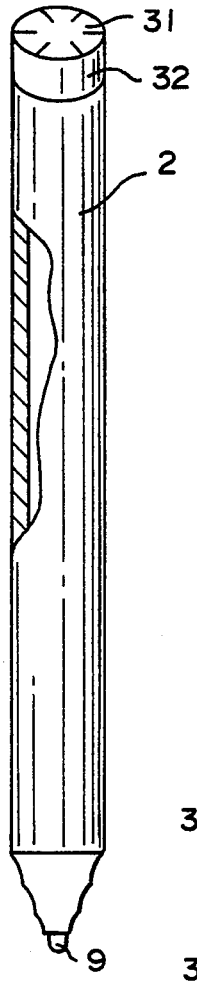
FIG. 13A is a schematic perspective view of the non-mingling multicolor ink pen of the present invention with a color identification means.
Figure 13B:
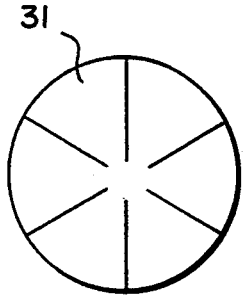
FIG. 13B is a schematic top view of the color identification means shown in FIG. 13A.

In FIGS. 13A and 13B is illustrated a non-mingling multicolor ink pen with a kind of color identification means according to the present invention which comprises: a transparent cover body 32 mounted on the rear end of the barrel 2, a color indication plate 31 with several color marks on its surface mounted in the cover body 32 for indicating the color of writing. The color indication plate 31 may be circular, elliptical, polygonal flat surface or arc surface in shape. The color marks on the plate may be lines, area, dots or letters of different colors for indicating the colors of writing. The kinds, number, arrangement direction, order and angles of color they indicated coincide with those of colors in writing.

The transparent cover body 32 may be manufactured by injection moulding process. The mounting structure between the rear end of the barrel 2 and the cover 32 is such that the ring shaped concave grooves of the inner wall of the cover 32 is matched with the ring shaped protruding shoulder on the outer surface of the rear end of the barrel 2 and these two can be adjusted by relative rotation. When assembling or using the multicolor ink pen, the transparent cover 32 may be adjusted so that the positions of colors indicated by color marks corresponds to the position of the color given by the tip in writing, then the position of the transparent cover 32 is fixed. In this way, a user needs only to select a certain color indicated by the color indication plate, the color given by the multicolor ink pen, when writing, will be what the user expects.

Alternatively, the color indication plate with flat surface (or arc surface) 31 may be mounted on the end portion of the pen cap of the multicolor ink pen and positioning lines are marked on the barrel and on the pen cap respectively. When the pen cap is put on the rear portion of the barrel, the positioning lines of the barrel and the pen cap are aligned so that the colors indicated by the color marks on the color indication plate 31 will correspond to the colors the combined tip gives in writing, in so doing, the said color identification means is ready for use for selecting colors.

Figure 14A:
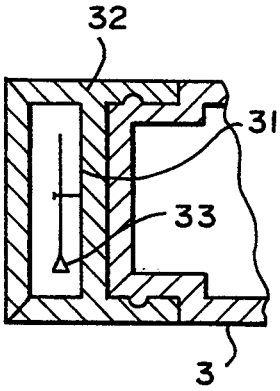
FIG. 14A is a schematic sectional view of a pointer type color identification means of the present invention.
Figure 14B:
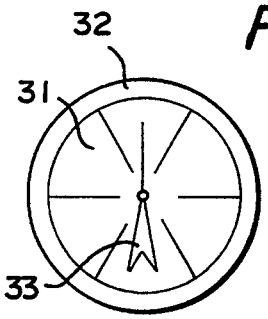
FIG. 14B is a schematic left view of the color identification means shown in FIG. 14A.

Now refer to FIGS. 14A and 14B. In order to enhance the correctness in color selection of the said color identification means. The present invention, on the basis of the abovementioned color identification means comprising a color indication plate 31 and a transparent cover body 32, provides a pointer type color identification means, that is, a supporting point is provided on the center of the flat surface or arc surface of the color indication plate 31 in the transparent cover body 32. On the said supporting point is rotatavly mounted a pointer 33 which can be rotated relative to the color indication plate. Due to the fact that the weights of the two arms of the pointer 33 are unequal, when the barrel 2 is inclined for writing, the heavier arm of the pointer 33 points always downward, while the lighter arm points always upwardly. If the single arm pointer is used, in this case, the pointer points always downward. According to the fact that the direction indicated is unvaried (constant), by adjusting the transparent cover body 32, and making the positions of the colors indicated by color marks on the color indication plate 31 correspond to the positions of the colors given by the tip in writing occurring, then no matter how the multicolor ink pen is rotated, the color indicated by the pointer 33 will be exactly the color given by the tip given by the tip when writing.

Figure 15A:
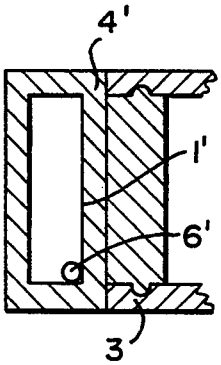
FIG. 15A is a schematic sectional view of a ball pointer color identification means of the present invention.
Figure 15B:
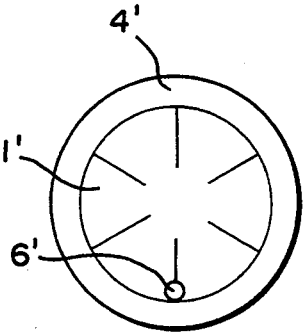
FIG. 15B is a schematic left view of the ball pointer type color identification means shown in FIG. 15A.

Referring to FIGS. 15A and 15B, similarly, a microball like member 34, such as metal or plastic bead may be movably provided on the flat surface or arc surface color indicating plate 31 in the transparent cover body 32. When writing, because of the weight of the microspheric member of its own, it is always downward. Due to the fact that the movement direction of the microspheric piece keeps constant anyhow, when assembling or using the multicolor, by adjusting and fixing correspondingly the transparent cover body 32, the positions of the colors indicated by the color indication plate 31 is made to correspond to the positions of the colors given by the tip in writing. When writing, the colors indicated by the spherical piece 34 will be the colors given by the tip while writing.

Figure 16:
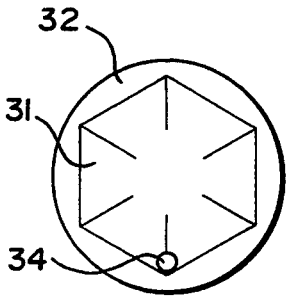
FIG. 16 is a schematic structure view of another ball pointer type color identification means of the present invention.

If the shape of the color indication plate 31 is of a certain kind of shapes such as circular, elliptical or polygonal one, the shape of the inner wall of the transparent cover body 32 must suit to it. In FIG. 16 is shown a hexagonal color identification means in which the color indication plate 31 and the inner wall of the transparent cover body are all of hexagonal shape.

Moreover, the color indication plate 31 may also be mounted on the rear end of the barrel 2 and the kind, number, arrangement direction, order, angle of the colors indicated by the color indication plate are made to correspond to those of the colors given by the multicolor ink pen upon writing.

FIGS. 17A through 21 show various tube shaped color identification means. The color identification means is a tube shaped member 35 mounted on the barrel 2. On the outer wall of the tube shaped member 35 are provided with several color marks to indicate the colors of writing. The kinds, number, arrangement direction, order and angle of colors indicated by the color are made to correspond to those of colors given by the multi-color ink pen upon writing.

When the multi-color ink pen with the above-mentioned color identification means is to be used, the color of writing will be the color required by the user by aligning with a certain color indicated by the color marks.

The color marks of the above-mentioned embodiments include: serval axial concave grooves 36 formed on the outer circumferential wall of the tube shaped member 35. In each of the concave grooves 36, one kind of color is marked for indicating the color of writing, the kinds, number, arrangement direction, order, angle of colors they indicate correspond to those of colors given by the multi-color ink pen upon writing. The said color marks may be also several color strips directly marked on the outer circumferential wall of the tube shaped member 35 for indicating the colors of writing.

Figure 17A:
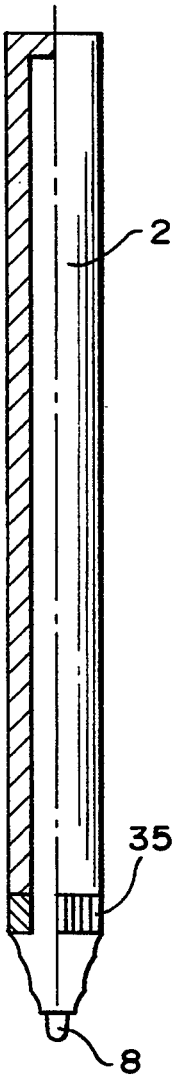
FIG. 17A is a schematic view of a non-mingling multicolor ink pen of the present invention with a short tube-like color identification means.
Figure 17B:
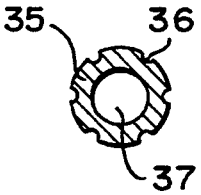
FIG. 17B is a schematic transverse sectional view of the short tube-like color identification means shown in FIG. 17A.
Figure 18A:
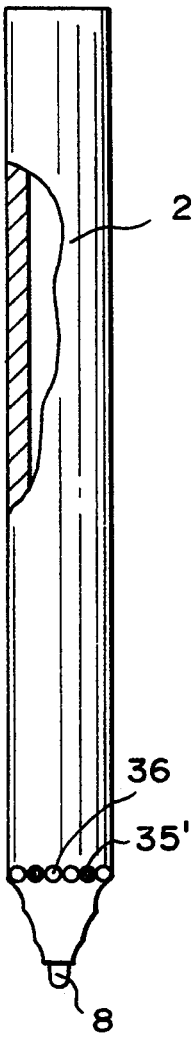
FIG. 18A is a schematic view of a non-mingling multicolor ink pen with an annular color identification means of the present invention.
Figure 18B:
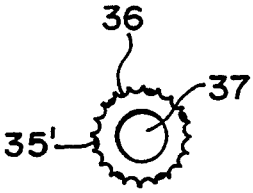
FIG. 18B is a schematic transverse sectional view of the annular color identification means shown in FIG. 18A.
Figure 19A:
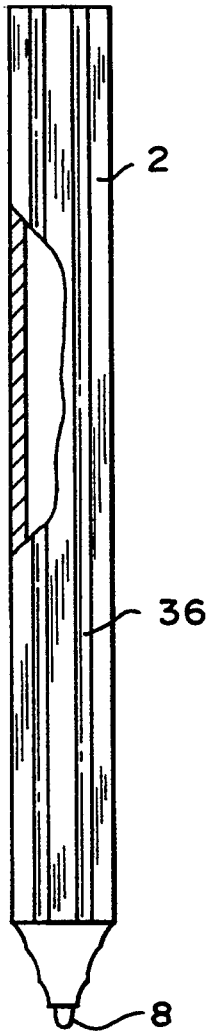
FIG. 19A is a schematic view of a non-mingling multicolor ink pen with a penholder type color identification means of the present invention.
Figure 19B:
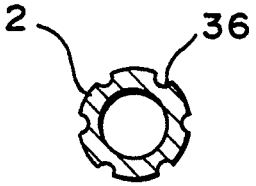
FIG. 19B is a schematic sectional view of a penholder type color identification means shown in FIG. 19A.

The length of the tube shaped member 35 may vary with the various requirements. If the length of the tube shaped member is of the same length as the length of the barrel 2, it can replace the barrel as shown in FIGS. 19A and 19B. If the shorter length is used, then it becomes a short tube shaped member 35 as shown in FIGS. 17A and 17B. If a still shorter length is used, it becomes a ring shaped member 35' as shown in FIGS. 18A and 18B. When the shorter or ring shaped member is used, they may be mounted on the barrel 2, in this case, the bore 37 of the said member is closely matched with the outer wall of the barrel 2, for example, is closely matched with the ring shaped concave on the barrel 2 and may be rotated relatively so that the position of colors can be adjusted when assembling is made or when the said multi-color ink pen is used for writing. Furthermore, the said tube shaped member can be also made integrated with the barrel 2.

Figure 20:
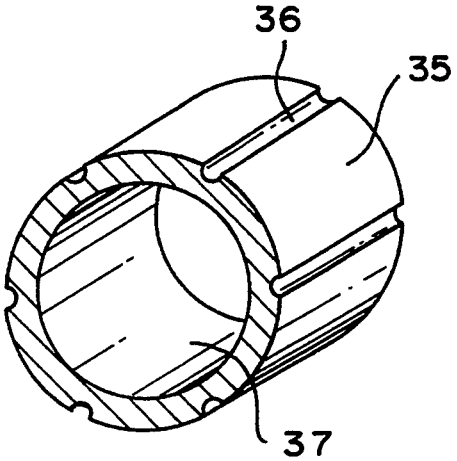
FIG. 20 is a schematic perspective view of a cylindric tube shaped color identification means of the present invention.
Figure 21:
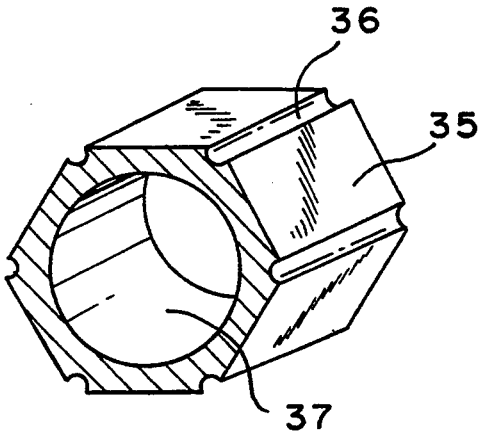
FIG. 21 show a schematic perspective view of a hexaprismatic tube shaped color identification means of the present invention.

The appearance of the tube shaped member 35 may be cylindrical as shown in FIG. 20, or may be multiprismatic in shape such as hexagonal prism as shown in FIG. 21, or elliptical or profiled prismatic in shape.

The short tube shaped color identification means according to the present invention may be mounted on the front part of the barrel 2 or on the central or rear part of the barrel 2.

We claim:

1. A non-mingling multicolor ink pen comprising a barrel, two or more ink reservoirs fixed or held in stationary position in said barrel, a combined tip including two or more elastic nibs each with ink tight surface, a nib guard tube having a rear end thereof fixedly connected to a front end of said barrel, nib position fixing means for securing or holding each of said nibs separated from each other in said nib guard tube with front ends thereof sticking out of the front end of said nib guard tube, and the rear ends of the nibs extending in the front end of said ink reservoirs, a nib holder movably mounted axially of said pen and having a conical bore with a front end opening at the front end of said nib guard tube and sheathing the front ends of the nibs for adjusting the spacing between the front ends of the nibs.

2. The multicolor ink pen according to claim 1, wherein said nib guard tube comprises a wall with a front portion defined by axial slots equal in number to said nibs thereby forming several segmented pieces, the nibs being respectively located inside each of said segmented pieces, an outer thread machined on the intermediate outside of said nib guard tube, an inner thread machined on the rear inside of said movable nib holder whereby said nib holder will operate to sheath said nib guard tube by engagement of said inner thread on said nib holder with said outer thread on said nib guard tube to effect axial movement over the front end of said nib guard tube.

3. The multicolor ink pen according to claim 2, wherein said nib position fixing means comprises a circular securing block fixedly embedded in the middle of the nib guard tube, said securing block having nib holes equal in number to the nibs uniformly formed thereon, the nibs being respectively secured in the nib holes, a positioning support fixed to said securing block with radially protruding pieces equal in number to the nibs, the radially protruding pieces being embedded in the matched positioning grooves on the rear inside of the nib guard tube; front portions of ink reservoirs located separately between said two adjacent radially protruding pieces, an elastic positioning frame extending in front of said circular fixing block, said positioning frame carrying radially protruding pieces equal in number to the nibs, the front portions of the nibs extending separately between said two adjacent radially protruding pieces of said positioning frame, a positioning ring located between said circular securing block and positioning frame, said positioning ring being secured around the intermediate outside of the nibs.

4. The multicolor ink pen according to claim 2, wherein said nibs position securing means comprise segment positioning pieces equal in number to the nibs and fixedly assembled in the intermediate interior of the nib guard tube and combined into a circular securing block, a nib hole or slot formed on each of said positioning piece, the nibs respectively extending in said nib holes or slots, radially protruding positioning pieces equal in number to said positioning pieces disposed in the rear interior of said nib guard tube uniformly along the periphery thereof, a positioning notch defined at each corner of both edges of each positioning piece with a width equal to half of that of the radially protruding positioning piece of the nib guard tube, said radially protruding positioning pieces being respectively embedded in said notches.

5. The multicolor ink pen according to claim 1, wherein said nib guard tube includes a front wall defined by at least one axial slot formed therein, said movable nibs holder being assembled axially movably in the front end of said nib guard tube, at least one radially protruding piece sticking out of the axial slots on the nib guard tube.

6. The multicolor ink pen according to claim 5, wherein said nib position securing means comprise a circular securing block fixedly embedded in the middle of the nib guard tube, nib holes equal in number to the nibs uniformly defined on said securing block, the nibs respectively extending securely in the nib holes, a positioning support secured to said securing block with radially protruding pieces equal in number to the nibs, the radially protruding pieces embedded in matched positioning grooves on the rear interior of the nib guard tube; front portions of said ink reservoirs extending individually between said two adjacent radially protruding pieces, an elastic positioning frame extending in front of said circular securing block, said positioning frame carrying radially protruding pieces equal in number to the nibs, the front portions of the nibs extending separately between said two adjacent radially protruding pieces of said positioning frame, a positioning ring extending between said circular securing block and positioning frame, said positioning ring extending securely around the intermediate outside of the tips.

7. The non-mingling multicolor pen according to claim 1, further comprising color indentification means provided on said barrel including a color indicating plate in a flat or arcuate surface assembled on the rear of said BARREL with several color indicating marks on the surface of said color indicating plate to indicate the color of writing.

8. The non-mingling multicolor ink pen according to claim 1, further comprising a transparent cover assembled adjacent the rear end of the barrel, a color indication plate provided in said transparent cover, wherein color marks are provided on the surface of the plate for indicating the colors of writing.

9. The non-mingling multicolor ink pen according to claim 1, further comprising color indentification means provided on said barrel including a transparent cover assembled adjacent the rear end of the barrel, said transparent cover having a color indicating plate provided thereon, wherein several color indicating marks are provided on the surface of said color indicating plate to indicate the color of writing and wherein a supporting point is provided in the center of the color indicating plate supporting thereon a rotatable pointer having two arms of unequal weight pointer rotatable with respect to the color indicating plate.

10. The non-mingling multicolor ink pen according to claim 8, wherein a microball-like member is provided for movement over said color indication plate in the transparent cover to indicate the colors of writing.

11. The non-mingling multicolor ink pen according to claim 1, wherein color identification means are provided on said barrel, said color identification means comprising a color indication plate in the shape of flat surface or arc surface assembled on the back end of the pen body and several color indicating marks on the surface of the color indication plate to indicate the colors of writing.

12. The non-mingling multicolor ink pen according to claim 1, further comprising color indentification means provided on said barrel including a transparent cover assembled adjacent the rear end of the barrel, said transparent cover having color indicating plate provided thereon, wherein several color indicating marks are provided on the surface of said color indicating plate to indicate the color of writing and wherein a supporting point is provided in the center of the color indicating plate supporting thereon a rotatable pointer having a single-arm pointer rotatable with respect to the color indicating plate.

* * * * *